United States Patent [19]

Yudovich

[11] Patent Number: 4,539,098

[45] Date of Patent: Sep. 3, 1985

[54] UPGRADING CARBONACEOUS MATERIALS

[75] Inventor: Amos Yudovich, Tulsa, Okla.

[73] Assignee: Phillips Petroleum Company, Bartlesville, Okla.

[21] Appl. No.: 623,595

[22] Filed: Jun. 22, 1984

[51] Int. Cl.[3] ..... C10G 1/04

[52] U.S. Cl. ..... 208/11 LE; 208/8 LE

[58] Field of Search ..... 208/11 LE, 8 LE, 11 R

[56] References Cited

U.S. PATENT DOCUMENTS

| | | | |
|---|---|---|---|
| 1,672,231 | 6/1928 | Ryan | 208/11 LE |
| 1,687,763 | 10/1928 | Hampton | 208/11 LE |
| 2,487,788 | 11/1949 | Buchan | 208/11 LE |
| 2,685,555 | 8/1954 | Findlay | 196/14 |
| 2,700,018 | 1/1955 | Gilbert | 208/11 R |
| 2,847,306 | 8/1958 | Stewart et al. | 208/11 LE |
| 3,018,243 | 1/1962 | Nevens | 208/11 LE |
| 3,058,904 | 10/1962 | Deering | 208/11 LE |
| 3,442,789 | 5/1969 | Zimmerman, Jr. | 208/8 LE |
| 3,551,322 | 12/1970 | Clampitt | 208/11 LE |
| 4,075,081 | 2/1978 | Gregoli | 208/11 R |
| 4,405,438 | 9/1983 | Faulkner et al. | 208/11 R |

*Primary Examiner*—D. E. Gantz
*Assistant Examiner*—A. Pal
*Attorney, Agent, or Firm*—John R. Casperson

[57] ABSTRACT

Recycle shale oil is used in an extractive pyrolysis process of oil shale. Hot gases from the pyrolyzer are used to preheat the shale.

6 Claims, 1 Drawing Figure

UPGRADING CARBONACEOUS MATERIALS

BACKGROUND OF THE INVENTION

The invention relates to upgrading carbonaceous materials. In one aspect, the invention relates to the extraction of kerogen-containing materials. In another aspect, the invention relates to an apparatus for conducting an extraction process.

In one of its aspects, the invention relates to the treatment of oil shale to recover oil products. The heavy fraction of the crude shale oil normally contains a large fraction of high boiling components. This product is very viscous and difficult to handle and has such a high Conradson carbon content that upgrading is very expensive. A use for the heavy shale oil fraction which has a boiling point of above 1000° F. would be desirable.

Many retorting processes cannot effectively process oil shale fines. These materials are usually rejected after the expense of transportation from the mine site to the shale conversion plant during screening operations. A process suitable for recovering oil from oil shale fines, especially fines having a size below ⅛ inch would be desirable.

Many pyrolysis processes for the extraction of shale oil from oil shale utilize partial combustion of the shale in a retort to provide the heat requirements of the pyrolysis process. Heat distribution through the retort is non-uniform, causing poor control over product distribution. The high temperatures in the combustion zone lead to over-cracking and metallurgical failures. Further, ecomomy of operation is hindered by heat dissipation due to excessively high combustor temperatures and poor heat transfer between the combustion gases and the shale. An oil yielding process which utilizes low temperature and improved temperature distribution would be desirable.

OBJECTS OF THE INVENTION

It is an object of this invention to use the heavy shale oil fraction derived from oil shale in the upgrading process.

It is another object of the invention to provide an upgrading process in which oil shale fines can be economically processed.

It is a further object of the invention to provide an oil shale upgrading process characterized by low maximum temperatures, low heat input, a more uniform temperature distribution and high heat transfer to the oil shale in the pyrolysis zone.

It is another object of the invention to provide an apparatus well adapted for carrying out certain aspects of the process of the invention.

STATEMENT OF THE INVENTION

In one aspect of the invention, a hot liquid oil is mixed with kerogen-containing particles to form a slurry. The slurry is maintained at a temperature in the range of 650° to 1250° F. in an extraction zone so as to extract kerogen from said particles. At least a portion of the kerogen is decomposed into lighter products which are recovered. The heavy fraction of crude shale oil can be used as the hot liquid oil. By using hot liquid oil as the heat transfer medium, heat transfer to the oil shale can be enhanced. By conductng an extractive pyrolysis in a slurry, small sized shale particles can be economically processed. By providing the process heat by means of hot liquid oil, in situ combustion can be avoided, resulting in more uniform temperature distribution and a lower maximum process temperature.

According to another aspect of the invention, an apparatus for upgrading kerogen-containing materials is characterized by an extractor vessel. A mixer is provided for forming a mixture of particulate material and liquid for the extractor vessel. A separator for separating the mixture of particulate and liquid is connected to a lower portion of the extractor vessel by a suitable conduit means. A fractionator for separating the liquid into a vaporous overhead stream and a liquid bottoms stream is connected to an upper portion of the separator vessel by a suitable conduit means. A conduit means connects a lower portion of the fractionator with the mixer. The apparatus is well suited for recycling a heavy oil residue obtained from an extractive oil shale pyrolysis process back to the extractive pyrolysis step. The various components of the crude shale oil are very miscible in this heavy fraction, thus making it a good and useful solvent. By heating the heavy oil residue prior to mixing it with the oil shale it can serve as the heating medium and solvent at the same time.

DETAILED DESCRIPTION OF THE INVENTION

Figure 1:
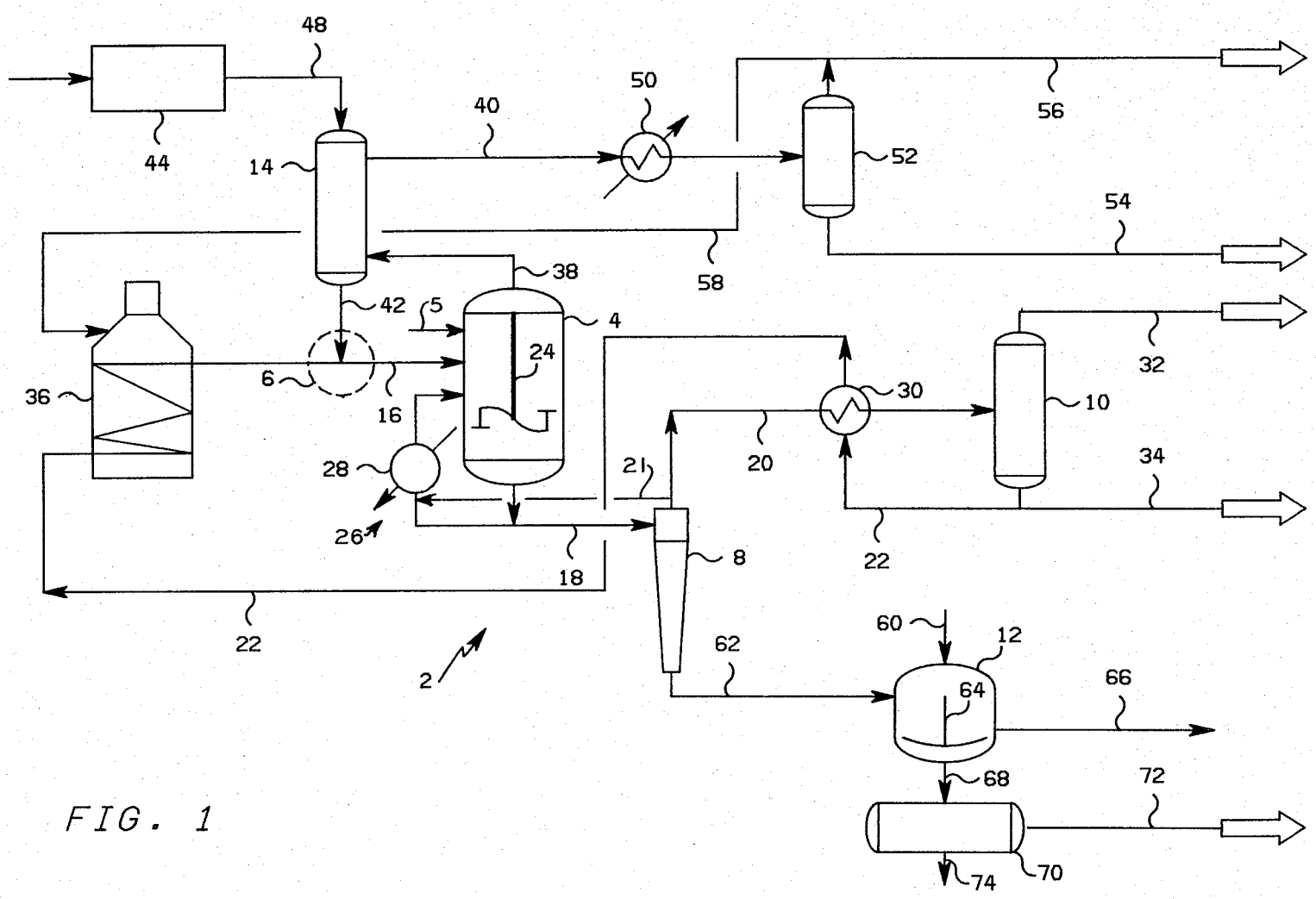
FIG. 1 illustrates schematically certain features of one embodiment of the present invention.

An apparatus 2 for carrying out certain features of the invention comprises an extractor-reactor vessel 4, a mixer illustrated generally by the numeral 6 for forming a mixture of particulate and liquid, liquid-solids separator such as a hydrocyclone 8 for separating particulate from liquid, and a fractionator 10 for separating a liquid into an overhead stream and heavy liquid bottoms stream. The apparatus 2 optionally comprises an oil from solids stripper 12 and an inlet solids handling system 14. The mixer 6 is operatively associated with the extractor vessel 4 and is generally in or connected to the extractor vessel 4 such as by a conduit means 16 so that a mixture or slurry of hot liquid oil and kerogen-containing particles can be provided in the extractor-reactor vessel 4. A second conduit means 18 connects a lower portion of the extractor vessel 4 with the liquid-solid separator 8. A third conduit means 20 connects an upper portion of the separator 8 with the fractionator 10. A lower portion of the fractionator 10 is connected to the mixer 6 by a fourth conduit means 22.

The design of the mixer 6 is not critical. The mixing of the hot oil and kerogen-containing particles can occur in the extractor vessel 4, if desired. In that case, the mixer 6 will be positioned in the extractor vessel 4. The advantage to using a separate mixer apart from the extractor 4 to form the slurry is that sealing is simplified, thus no lock hopper is required. This is especially critical when operating the extractor-reactor 4 at much greater than atmospheric pressures, e.g. when hydrogen is optionally added to vessel 4 through a line 5 as in hydropyrolysis.

The extractor vessel 4 is preferably sufficiently sized to provide for a residence time of the kerogen-containing particles therein for a period of time generally in the range of 0.1 to about 1 hour. Because the particles in the slurry will tend to settle, the extractor-reactor 4 is preferably provided with a mechanical stirrer 24 to provide for uniform conditions of material concentrations and temperatures throughout the extractor-reactor 4. The extractor-reactor 4 is preferably further provided with a reboiler means 26 which is provided with a heater 28 to make up for heat lost from the extractor-reactor by heat radiation and the evolution of gases.

The separator 8 preferably is of the inertial type, such as a liquid-solid centrifugal separator, commonly called hydrocyclone. A sufficiently large settler vessel could serve as the separator 8 if desired and would also be expected to provide good results where provision is made to keep the mixture to be separated relatively nonviscous, such as by use of a diluent and/or maintenance of the separator at elevated temperatures. Where diluent is used, it is preferred to recycle a portion of the overhead stream from separator 8 through conduit 21. The non-recycled overhead from the separator 8 can be subjected to further clarification if desired, such as by means of filtration or electrostatic precipitation and is then passed via conduit 20 and preferably through a heater 30 into the fractionator 10.

The fractionator 10 is preferably operated under conditions to produce a bottoms stream carried by the conduit 22 which has an initial boiling point in the range of 650° to 1250° F., preferably in the range of 850° to 1150° F., most preferably in the range of 900° through 1000° F. To mitigate coking in the fractionator, it is preferred that the fractionator 10 be operated under conditions of partial vacuum and with the use of steam or other volatile diluent. The overhead stream from the fractionator 10 will usually be the equivalent of a gas oil and can be conveyed from the fractionator 10 via a conduit 32. The bottoms stream from the fractionator 10 is the equivalent of a highly refractory residium and if desired, a portion of it can be withdrawn from a lower portion of the column 10 such as via the conduit 22 and routed for other uses such as fuel or a carbon black feedstock via a conduit 34.

If desired, at least a portion of the fluid carried by the conduit 22 can be routed through the heater 30 to provide heat to the stream in conduit 20 to be fractionated. Generally, it will be found desirable to preheat the contents carried by the conduit 22 prior to the forming of the slurry at mixer 6. In a preferred embodiment, the conduit 22 is passed through at least one preferably gas-fired furnace 36 positioned between the fractionator 10 and the mixer 6. The furnace 36 can be fired by process gas obtained from the light ends or the heavy ends from the extractive pyrolysis process. Generally, sufficient heat is provided in the furnace 36 so that the contents of the conduit 22 are heated to a temperature in the range of 650° to 1250° F. Two or more furnaces 36 are preferably operated in parallel to avoid unnecessary process interruptions for cleaning out coke deposits from one of them.

To preheat and dry the raw shale to avoid excessive reflux caused by steaming in the extractor-reactor 4, the inlet solids handling system which includes a vessel 14 can be connected to an upper portion of the extractor-reactor vessel 4 with a conduit means 38. Preferably a portion of the hot gases introduced into the vessel 14 from the extractor-reactor 4 via the conduit 38 can be withdrawn from the inlet system 14 by the conduit 40. Preferably the vessel 14 includes a fluidized bed of solids and the hot gas is introduced into the vessel for intimate contact and heat exchange with the particles therein. Condensed liquids are conveyed together with the particulate into the mixer 6 via a conduit means 42 which connects the vessel 14 with the mixer 6. Raw kerogen-containing particles such as oil shale are received into the vessel 14 from a sizing operation 44, via a conduit 48. Preferably the flow of hot gases through the vessel 14 from the conduit 38 to the conduit 40 is in a countercurrent direction to the flow of particulate material through the lock hopper 14 from the conduit 48 to the conduit 42. Operation in this manner, using intimate countercurrent contact between the particulate material and the gases, assures most efficient heat transfer.

The gases carried by the conduit 40 can be cooled in a cooler 50 and introduced into a fractionator 52 which is connected to the vessel 14 by the conduit 40. The bottoms stream from the fractionator 52 can be the equivalent of a light gas oil or naphtha. The bottoms stream from the fractionator 52 can be conveyed to further processing via a conduit 54. The overhead stream from the fractionator 52 will generally comprise $C_4$ and lighter hydrocarbons, steam, sulfurous gases, hydrogen, and carbon dioxide. A portion of the overhead stream can be conveyed to further processing by conduit 56. A portion of the overhead from fractionator 52 can be burned in the gas-fired furnace 36 to provide process heat via a conduit 58.

The wash vessel or stripper 12 is preferably connected to a source of water and/or steam which empties thereinto via a conduit 60. A conduit 62 connects a lower portion of the separator 8 with the wash vessel 12. To obtain good results the wash vessel 12 is preferably provided with a mechanical stirrer 64. Spent oil shale is withdrawn from the wash vessel 12 via a conduit 76. A mixture of water and shale oil is withdrawn from the wash vessel 12 via a conduit 68. The conduit 68 empties into an oil-water separator vessel 70 which is operated under conditions to obtain a phase separation between the shale oil and the water contained therein. A stream of shale oil, generally the equivalent of a vacuum gas oil or heavier can be withdrawn from the settler 70 via a conduit 72. A water stream which can be suitable for a recycle to the conduit 60 can be withdrawn from the oil/water separator 70 via a conduit 74.

In the process of the invention, a hot liquid oil is mixed with kerogen-containing particles to form a slurry. The slurry is maintained at a temperature in the range of from about 650° to about 1250° F. in an extraction zone for a period of time sufficient to insure extraction of kerogen by the hot oil and to decompose a portion of the kerogen into lighter products and at least a portion of the lighter products is recovered. Preferably, the slurry will be formed from oil shale particles which have a size chiefly in the range of from about 0.001 to about 1 inch on a weight basis, and the hot oil to be admixed with the oil shale will have been preheated to a temperature in the range of from about 700° to about 1100° F. Usually, the hot oil will be from a shale oil fraction and will have an initial boiling point in the range from about 650° to about 1000° F. Generally speaking, from about 1 to about 10 parts by weight of hot oil will be mixed with each part by weight of oil shale. Usually, from about 1 to about 5 parts by weight of hot oil will be mixed with each part by weight of oil shale. Where the oil shale has been preheated to a temperature in the range of from about 200° to about 1000° F., such as by contact with off-gases from the extractor-reactor, the amount of hot oil used will be in the lower end of the range. Good results are expected where the oil shale particles have a size chiefly in the range of from about 0.01 to about 0.5 inches on a weight basis and have been preheated by contact with hot gases to a temperature in the range from about 300° to about 800° F. The slurry is most preferably formed with hot residual shale oil having an initial boiling point in excess of 800° F. The slurry is preferably maintained at a temperature in the range of from about 800° to about 1000° F. for a period of time in the range of 0.01 to about 1 hour, more preferably 0.1–0.3 hours.

To obtain most economical results, it is desirable to recover as much heat as possible from the spent oil shale. To achieve this, at least a portion of the oil shale is separated from at least a portion of the hot liquid oil, such as in the separator 8, and the oil shale is cooled in a cooling zone such as the wash or separator vessel 12. Low pressure steam can be generated in the wash vessel and withdrawn by means not shown. The hot liquid oil withdrawn from the extractor 4 can be fractionated into a light fraction and a hevy fraction and a portion of the heavy fraction can be used to form the hot liquid oil which is used in the extraction step. A stream of spent shale is withdrawn from the cooling zone and properly disposed of. A stream of cooling fluid and oil is withdrawn from the cooling zone and generally separated into oil for further processing and cooling fluid which can be recycled.

Hot gases from the extraction zone can be utilized to preheat the kerogen-containing particles to be used in forming the slurry. Most preferably, this stream of hot gases is routed into direct countercurrent contact with the kerogen-containing particles for direct heat exchange, such as in a countercurrent moving or fluidized bed process.

EXAMPLE I

This example illustrates the extraction of kerogen from Kentucky oil shale with a heavy oil similar to the heavy oil fraction (boiling 1000° F.+) of an oil shale retorting process. The heavy oil employed was a No. 6 fuel oil (flash point: 137° F.; pour point: +55° F.; ash: 0.07 wt-%; S: 1.72 wt-% N: 0.48 wt-%; H: 9.94 wt-%; Kinetic viscosity at 100° F.: 1549.1 centistoke; Kinetic viscosity at 120° F.: 533.6 centistoke).

About 10 grams of ground oil shale were washed with pentane, dried, placed in a 500 cc flask and covered with about 20.6 grams of No. 6 fuel oil. The mixture was refluxed at about 370°–380° C. employing a 40 cm long water-cooled Liebig condenser. Some $H_2S$ generation was detected at 365° C. and above.

The following heating schedule was employed, controlled by a Varian potentiometer interfaced with the heating mantle.

| Heating Time | Temperature |
|---|---|
| 0 minutes | 100° C. |
| 10 minutes | 150° C. |
| 15 minutes | 250° C. |
| 20 minutes | 305° C. |
| 30 minutes | 365° C. |
| 40 minutes | 377° C. |
| 50 minutes | 369° C. |

The flask content was allowed to cool and was then washed about 12 times with toluene (total toluene volume: 375 cc). The extracted shale oil was dried under as nitrogen stream and weighed. A weight loss of 0.64 grams of the shale was measured representing a loss of 6.3 wt-%. Retorting in accordance with the Fischer Assay procedure of the Kentucky oil shale was about 10.5–10.6 wt-%. Thus the extraction of the shale oil in accordance with this invention removed about 60% of the recoverable kerogen from the oil shale.

The toluene of the wash solution was evaporated, and 19.7 grams of oil was recovered. This suggests that some oil was lost in the described process by decomposition and carbonization.

EXAMPLE II

This calculated example illustrates the operation of a large-scale plant that produces a total of about 50,000 barrels/day (BBL/day) of liquid hydrocarbon products (light oil, medium distillate and heavy bottoms) and about 15 million SCF/day of saleable fuel gas ("export" gas). The estimated total energy requirement to operate the plant is about $744 \times 10^6$ BTU/hr. The raw material is a 200 mesh Western Colorado oil shale having a Fischer assay value of about 30.6 gallons/ton. A material balance and pertinent product characteristics are summarized in Table I.

TABLE I

| Material | Stream No. (FIG. 1) | Input tons/day | Output tons/day | Output bbl/day | Output scf/day | Boiling Range (°F.) | Gross Heating Value (BTU/Scf) |
|---|---|---|---|---|---|---|---|
| Raw Oil Shale | 48 | 70,030 | — | — | — | — | — |
| Spent Shale | 66 | | 61,238(1) | — | — | — | — |
| "Export" Gas | 56 | | 455 | — | $14.9 \times 10^6$ | — | 850 |
| In-Plant Fuel Gas | 58 | | 640 | — | $21 \times 10^6$ | — | 850 |
| Light Oil | 54 | | 895 | 6,478 | — | <470 | — |
| Medium Distillate | 32 | | 4,875 | 32,041 | — | 471–943 | — |
| Heavy Bottoms I | 34 | | 1,451 | 8,734 | — | >943 | — |
| Heavy Bottoms II | 72 | | 476 | 2,865 | — | >943 | — |
| Total | | 70,030 | 70,030 | | | | |

(1)includes about 305 tons of unextracted heavy oil.

Should it be desired to combine the lights, medium distillate and heavy bottoms streams (54, 32, 34, 72) for pipeline transportation, a blended product oil having the approximate boiling point distribution given in Table II would be obtained.

TABLE II

| Vol. % Evaporated | Boiling Point (°F. at 1 atm) |
|---|---|
| 0 | 280(1) |
| 5 | 404 |
| 10 | 469 |
| 20 | 577 |
| 30 | 666 |
| 40 | 745 |
| 50 | 815 |
| 60 | 875 |
| 70 | 943 |

TABLE II-continued

| Vol. % Evaporated | Boiling Point (°F. at 1 atm) |
|---|---|
| 77 | 990 |

(1)initial boiling point

Pertinent operating conditions are: (1) a ratio of hot gas to oil shale in heat exchanger 14 of about 560 SCF per ton of ground (200 mesh) raw oil shale; (2) an operating temperature of about 900° F. in the extractor-reactor 4; (3) a residence time of the oil shale in the reactor-extractor 4 of about 10 minutes; (4) a weight ratio of hot oil to oil shale of about 2:1 in the reactor-extractor.

I claim:

1. A process comprising (a) mixing a hot liquid oil with oil shale particles to form a slurry; wherein the slurry is formed by mixing each 1 part by weight of oil shale which has been preheated by contact with hot gases to a temperature in the range of 200°-1000° F. within the range of from about 0.2 to about 20 parts by weight of the hot oil;

(b) maintaining the slurry at a temperature in the range of 650°-1250° F. in an extraction zone for a period of time sufficient to decompose a portion of the oil shale into lighter products;

(c) withdrawing a stream of hot gases from the extraction zone;

(d) passing said stream of hot gases into contact with the oil shale particles to be used in forming the slurry;

(e) separating the at least a portion of the oil shale from the at least a portion of the hot liquid oil;

(f) fractionating the hot liquid oil in a fractionation zone; and (g) cooling the oil shale in a cooling zone.

2. A process as in claim 1 wherein the slurry is formed by mixing 1 part by weight of oil shale which has been preheated by contact with hot gases to a temperature in the range of 300°-800° F. with from about 1 to about 10 parts by weight of the hot oil and the oil shale particles have a size chiefly in the range of about from 0.01 to about 0.5 inches on a weight basis.

3. A process as in claim 2 wherein the slurry is maintained at a temperature in the range of 800° to 1000° F. for a period of time in the range of 0.01 to about 1 hour.

4. A process as in claim 3 wherein the hot oil has an initial boiling point in excess of 1000° F.

5. A process as in claim 4 further comprising separating the at least a portion of the oil shale from the at least a portion of the hot liquid oil, fractionating the hot liquid oil in a fractionation zone and cooling the oil shale in a cooling zone.

6. A process as in claim 5 wherein hot liquid oil is fractionated into a light fraction and a heavy fraction, and the hot liquid oil used in forming the slurry comprises at least a portion of the heavy fraction.

* * * * *